US010420389B2

(12) United States Patent
Audet

(10) Patent No.: US 10,420,389 B2
(45) Date of Patent: Sep. 24, 2019

(54) FOOTWEAR WITH FORCED AIR VENTING

(71) Applicant: CODET INC., Coaticook (CA)

(72) Inventor: Jean-Pierre Audet, Coaticook (CA)

(73) Assignee: Codet Inc., Coaticook, Quebec (CA)

( * ) Notice: Subject to any disclaimer, the term of this patent is extended or adjusted under 35 U.S.C. 154(b) by 141 days.

(21) Appl. No.: 15/411,590

(22) Filed: Jan. 20, 2017

(65) Prior Publication Data

US 2017/0208895 A1 Jul. 27, 2017

Related U.S. Application Data

(60) Provisional application No. 62/281,342, filed on Jan. 21, 2016.

(51) Int. Cl.
*A43B 7/08* (2006.01)
*A43B 7/10* (2006.01)

(52) U.S. Cl.
CPC ..... *A43B 7/081* (2013.01); *A43B 7/082* (2013.01); *A43B 7/085* (2013.01); *A43B 7/088* (2013.01); *A43B 7/105* (2013.01)

(58) Field of Classification Search
CPC ..... A43B 7/081; A43B 7/082; A43B 7/084; A43B 7/085; A43B 7/087; A43B 7/088; A43B 7/10; A43B 7/105
USPC ..... 36/3 A, 3 B, 3 R
See application file for complete search history.

(56) References Cited

U.S. PATENT DOCUMENTS 4,224,746 A * 9/1980 Kim ..... A43B 17/08 36/3 B
4,835,883 A * 6/1989 Tetrault ..... A43B 7/081 36/147
5,086,572 A * 2/1992 Lee ..... A43B 7/081 36/3 A
5,220,791 A * 6/1993 Bulzomi ..... A43B 7/081 36/3 A
6,041,518 A * 3/2000 Polycarpe ..... A43B 3/0005 36/2.6
8,074,374 B2 * 12/2011 Chang ..... A43B 7/082 36/3 B
2003/0145486 A1 * 8/2003 Cardarelli ..... A43B 3/0078 36/3 B
2005/0005473 A1 * 1/2005 Oh ..... A43B 7/081 36/29
2005/0223594 A1 * 10/2005 Issler ..... A43B 7/08 36/3 B (Continued)

*Primary Examiner* — Ted Kavanaugh
(74) *Attorney, Agent, or Firm* — Mathieu Audet

(57) ABSTRACT

A forced-air footwear is presented and comprises a foot supporting portion including a sole with cavities therein covered with a foot-contacting layer, and a channel communicating between the cavities and the interior of the footwear to allow air flow between the cavities and the interior of the footwear; a foot covering portion, the foot covering portion including a valve allowing air passage therethrough in a single direction, the cavities including a compressed configuration, when supporting a weight of a wearer, and an expanded configuration when not supporting the weight of a wearer, the passage between the compressed configuration and the expanded configuration forcing an air movement of the air contained in the cavities, the valve blocking the air movement in one direction, wherein the compression of the cavities and the blocking action of the air by the valve is forcing air through the footwear.

16 Claims, 12 Drawing Sheets

(56) References Cited

U.S. PATENT DOCUMENTS

| | | | | |
|---|---|---|---|---|
| 2015/0272270 | A1* | 10/2015 | Im | A43B 7/088 36/29 |
| 2017/0150783 | A1* | 6/2017 | Polegato Moretti | A43B 7/085 |
| 2017/0258177 | A1* | 9/2017 | Audet | A41D 27/28 |

* cited by examiner

FOOTWEAR WITH FORCED AIR VENTING

CROSS-REFERENCE

The present invention relates to and claims priority from U.S. Provisional Patent Application No.: 62/281,342, filed Jan. 21, 2016, entitled FOOTWEAR WITH FORCED AIR VENTING, which is incorporated herein by reference in its entirety.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved

FIELD OF THE INVENTION

This invention relates generally to a footwear including an air venting mechanism. More precisely, the present invention relates to a forced air venting mechanism for a footwear that is actuated by foot pressure on a sole of the footwear.

BACKGROUND OF THE INVENTION

Footwear, like shoes and boots, can become too warm given the lack of air circulation therein. This is particularly the case of boots and safety footwear.

Using a permeable exterior material can allow some air circulation however, the quantity of air that is circulating remains uncertain and the footwear can remain uncomfortably warm and retain a high level of humidity therein.

It is therefore desirable to provide an improved air circulation mechanism for a footwear over the existing art.

It is therefore desirable to provide an improved air circulation mechanism for a footwear that is increasing the quantity of air that goes through the footwear over the existing art.

It is therefore desirable to provide an improved air circulation mechanism for a footwear that is forcing air through the footwear over the existing art.

Other deficiencies will become apparent to one skilled in the art to which the invention pertains in view of the following summary and detailed description with its appended figures.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description of exemplary embodiments that is presented later.

Therefore, one object of the present invention improves at least some of the deficiencies associated with the drawbacks identified above.

It is one aspect of our work to provide, in accordance with at least one embodiment thereof, a footwear with improved air circulation capability.

It is an aspect of our work to provide, in accordance with at least one embodiment thereof, a footwear with forced air circulation capability.

It is an aspect of our work to provide, in accordance with at least one embodiment thereof, a footwear with forced air circulation capability activated by a compression of a sole of the footwear when a wearer walks with the footwear and cyclically apply pressure on the sole of the footwear.

It is an aspect of our work to provide, in accordance with at least one embodiment thereof, a footwear with forced air circulation capability activated by a compression of cavities in a flexible sole of the footwear that are compressible when a wearer walks with the footwear and apply pressure on the cavities therein.

It is an aspect of our work to provide, in accordance with at least one embodiment thereof, a footwear with forced air circulation using a valve therein to ensure an air movement in a single direction through the footwear.

It is an aspect of our work to provide, in accordance with at least one embodiment thereof, a footwear with forced air circulation using a valve therein to ensure an air movement through the footwear, the valve being configured to either push air out of the footwear or pull air in the footwear.

It is an aspect of our work to provide, in accordance with at least one embodiment thereof, a footwear with forced air circulation capability activated by repetitive compressions of cavities in the sole when a wearer walks with the footwear.

It is an aspect of our work to provide, in accordance with at least one embodiment thereof, a footwear with channels allowing air from recessed portions in a sole of the footwear to communicate with the environment.

It is an aspect of our work to provide, in accordance with at least one embodiment thereof, a footwear with channels therein allowing air from cavities, or recessed portions, in a sole of the footwear to communicate the air in the recessed portions of the sole with the environment.

It is an aspect of our work to provide, in accordance with at least one embodiment thereof, a footwear using recessed portions in a molding of a polymeric sole as an air pump used to force air through the footwear when the recessed portions are compressed and expanded with the pressure exercised on the sole by a foot of a wearer that is walking with the footwear.

These and other advantages and features of the present invention will become apparent from the following description and the attached drawings. In addition to the aforementioned objects, aspects, features and work of the present invention, it should be noted that the present invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the present invention now will be described in detail with reference to the accompanying drawings, wherein the same elements are referred to with the same reference numerals, and wherein.

DESCRIPTION OF EMBODIMENT(S) OF THE INVENTION

Figure 1:
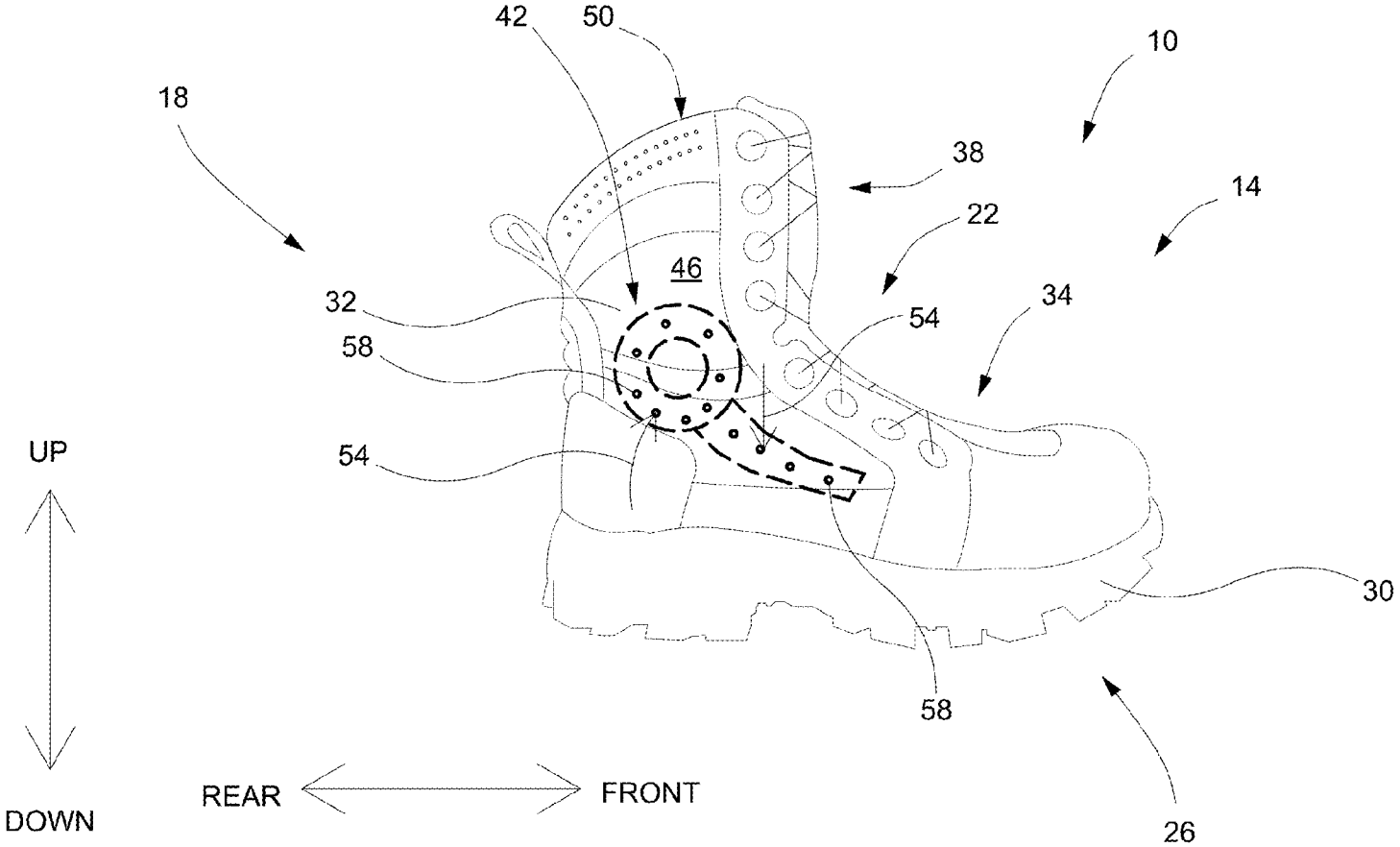
FIG. 1 is a right-side elevation view of a footwear in accordance with an embodiment of the present invention.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention, and is made merely for the purpose of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring the drawings, one or more preferred embodiments of the invention are next described. The following description of one or more preferred embodiments is merely exemplary in nature and is in no way intended to limit the invention, its implementations, or uses.

A footwear 10 is illustrated in FIG. 1. The footwear 10 is embodied as a boot for illustrative purposes however, the present invention could be implemented in other types of footwear like work boots, hiking boots, work shoes, shoes, sport shoes and the like that are configured to cover the foot and prevent free air circulation around the foot without departing from the scope of the specification. The footwear 10 includes a forward portion 14 for receiving toes of a wearer therein, a rear portion 18 for receiving a heel therein, a proximal side 22 and a distal side 26 (relative to a pair of footwears). The footwear 10 includes a sole portion 30, a foot-covering portion 34 and an optional upper covering portion 38 generally covering the upper portion of an ankle and a lower leg.

Figure 2:
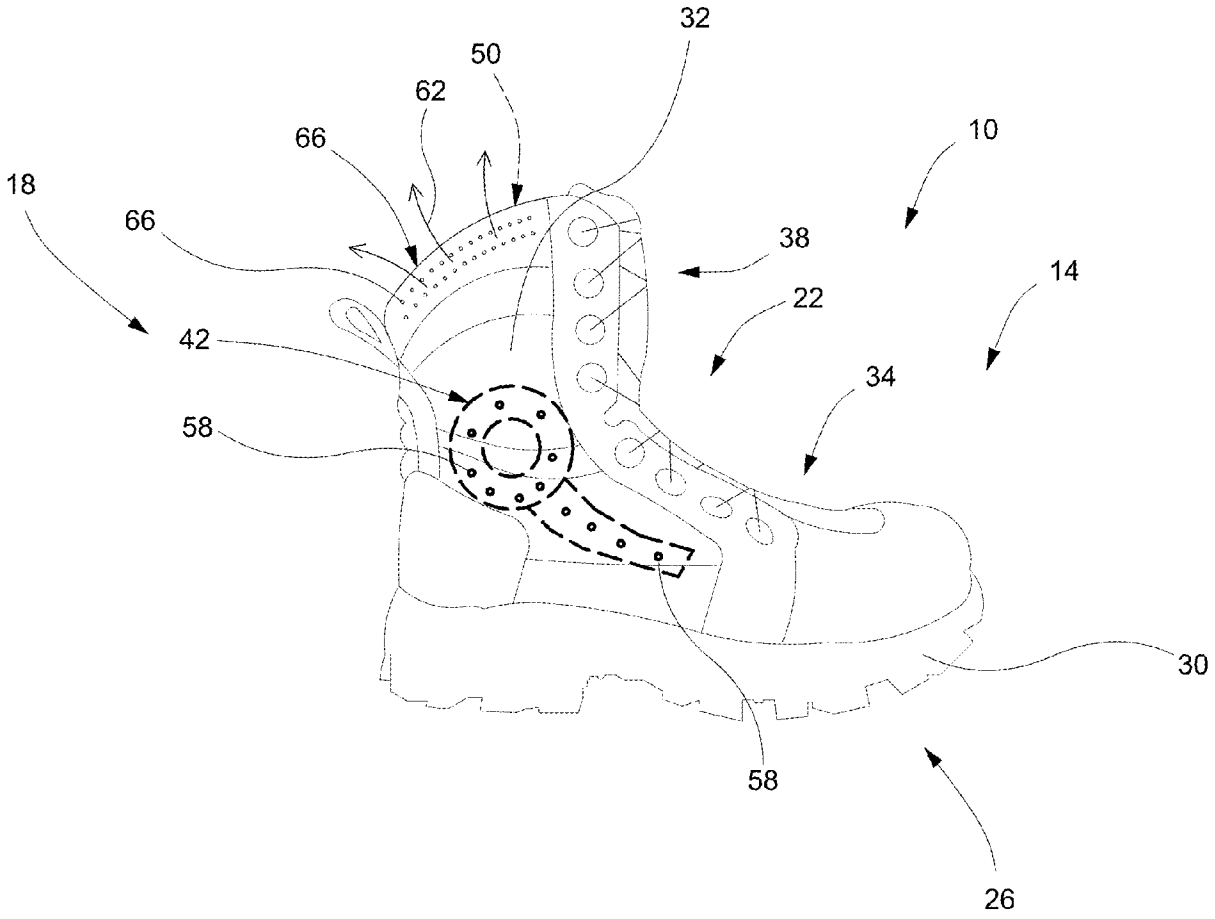
FIG. 2 is a right-side elevation view of a footwear in accordance with an embodiment of the present invention.

The footwear 10 illustrated in FIG. 1 and FIG. 2 includes, in accordance with an embodiment of the invention, a valve 42 illustratively disposed on a side of the footwear 10 and adapted to allow air to be routed through the footwear 10. The valve 42 is generally allowing air passage in a single direction to force flow through the footwear 10. Details about the valve 42 construction is going to be discussed below with more details. There could be a single valve 42 on one lateral side of the footwear 10 or, alternatively, two valves 42, disposed on respective sides 22, 26 of the footwear 10. The illustrated side valve 42 is embodied with a shape adapted to contour the ankle and extends toward the forward portion 14. The valve 42 is generally located under the exterior layer 46 of the footwear 10 and over the interior layer 50 of the footwear 10. The valve 42 is made of a semi-flexible material allowing movements thereof to act as a valve while being rigid enough to maintain its operative shape. In the present embodiment, the series of holes 58 of the valve 42 are made in the exterior layer 46 made of generally strong material, like leather. The series of holes 58 in the exterior layer 46 is operatively coupled with a blocking layer 74 that can be embodied as a lighter airtight material like thin ethylene-vinyl acetate (EVA), also known as poly (ethylene-vinyl acetate) (PEVA), that is a flexible and impermeable copolymer of ethylene and vinyl acetate. The components' materials of the valve 42 are effected by temperature. If the temperature is low, the blocking layer 74 is going to be more rigid and the valve 42 is going to allow less air therethrough hence limiting the cooling of the footwear 10 in cold weather conditions. Conversely, the blocking layer 74 is going to be more or less rigid and the valve 42 is going to allow more air therethrough hence increasing the cooling of the footwear 10 in warm weather conditions.

In an embodiment, the valve 42 is configured to force air inside the footwear 10 and selectively blocks the flow of air toward the exterior of the footwear 10. The valve 42 could be used to block the flow of air in the opposite direction and force the flow of air toward the interior of the footwear 10, in another embodiment, which would be understandable by a skilled reader in the art considering the description of the illustrated embodiments. The illustrated valve 42 is located on a lateral side portion of the footwear 10 however, other types of valves configured and packaged differently but providing suitable results could be located elsewhere in a region of the footwear 10 (e.g. on top of the footwear 10, on the back of the footwear 10) suitable for selectively blocking the flow of air without departing from the scope of the invention.

The air is vacuumed 54 through the exterior layer 46 of the footwear 10 through the series of holes 58 disposed in an operating configuration for proper interaction with the blocking layer 74. The series of holes 58 interacting with the valve 42 could communicate directly with the environment or be hidden under another exterior layer (not illustrated) of the footwear 10 assembled in a configuration that is allowing air to go therethrough. The air is extracted 62 from the footwear 10 generally through the interior layer 50 that is permeable to air and vapor. The fabric material and yarning thereof are adapted to allow air passage. Alternatively, a series of openings 66 located, for instance, on the upper covering portion 38 of the footwear 10 in the illustrated embodiment can be used to extract air from the footwear 10. The extraction of air from the footwear 10 can be made through the permeability of an intervening foam layer (not illustrated) between the exterior layer 46 and the interior layer 50 of the footwear 10 and be extracted through other portions of the footwear 10 without departing from the scope of the invention. For example, the interior layer 50 can be embodied with an air-permeable honeycomb-like layer structure that optionally includes insulation properties. An interior layer 50 made of such air-permeable structure can allow air to flow within side structure of the footwear 10 and to flow between the sole portion 30 to the upper sides of side portions 32.

Figure 4:
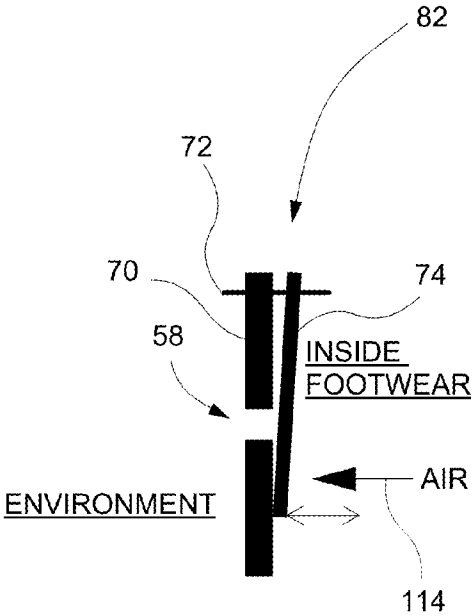
FIG. 4(A) and FIG. 4(B) are illustrating two states of the valve in accordance with an embodiment of the present invention.
Figure 4:
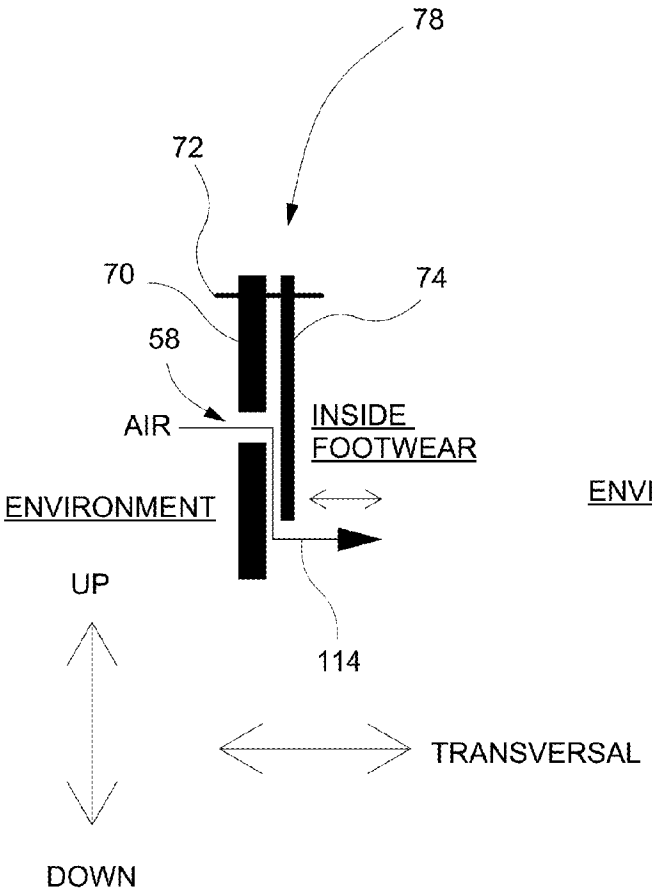
Figure 3:
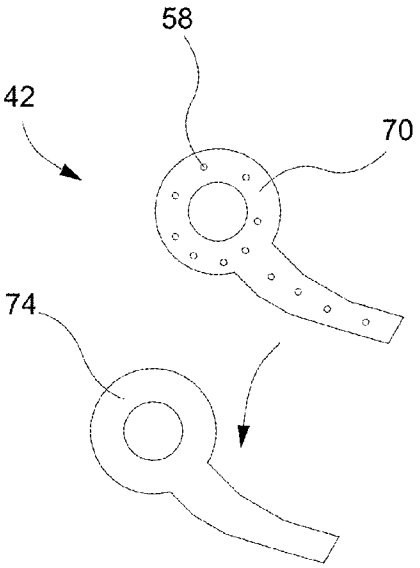
FIG. 3 is and exploded side elevation view of a valve in accordance with an embodiment of the present invention.

FIG. 3 depicts an embodiment of the valve 42. The exemplified valve 42 has a general shape adapted to be laterally superposed to an ankle and extending on the side of the footwear 10. The valve 42 illustrated in FIG. 3 is generally made of an air permeable layer 70 and a blocking layer 74. Both layers 70, 74 are superposed and secured together with a securing element 72, as illustrated in FIG. 4(A) and FIG. 4(B), in an air passing configuration 78 and an air blocking configuration 82, respectively. In an embodiment, FIG. 4(A) is illustrating the valve 42 in a configuration allowing air inside the footwear 10, forced by the vacuum created by the expansion of cavities 98 in the sole 86 of the footwear 10 and FIG. 4(B) is illustrating the valve 42 in a configuration blocking air from inside the footwear 10 to get out to the environment through the series of holes 58, forced by the pressure created by the compression of the cavities 98 in the sole 86 when pressure from the foot is removed from the sole 30. Both configurations could be embodied with a different structure providing similar results, structures that are considered to be part of the present invention.

Figure 5:
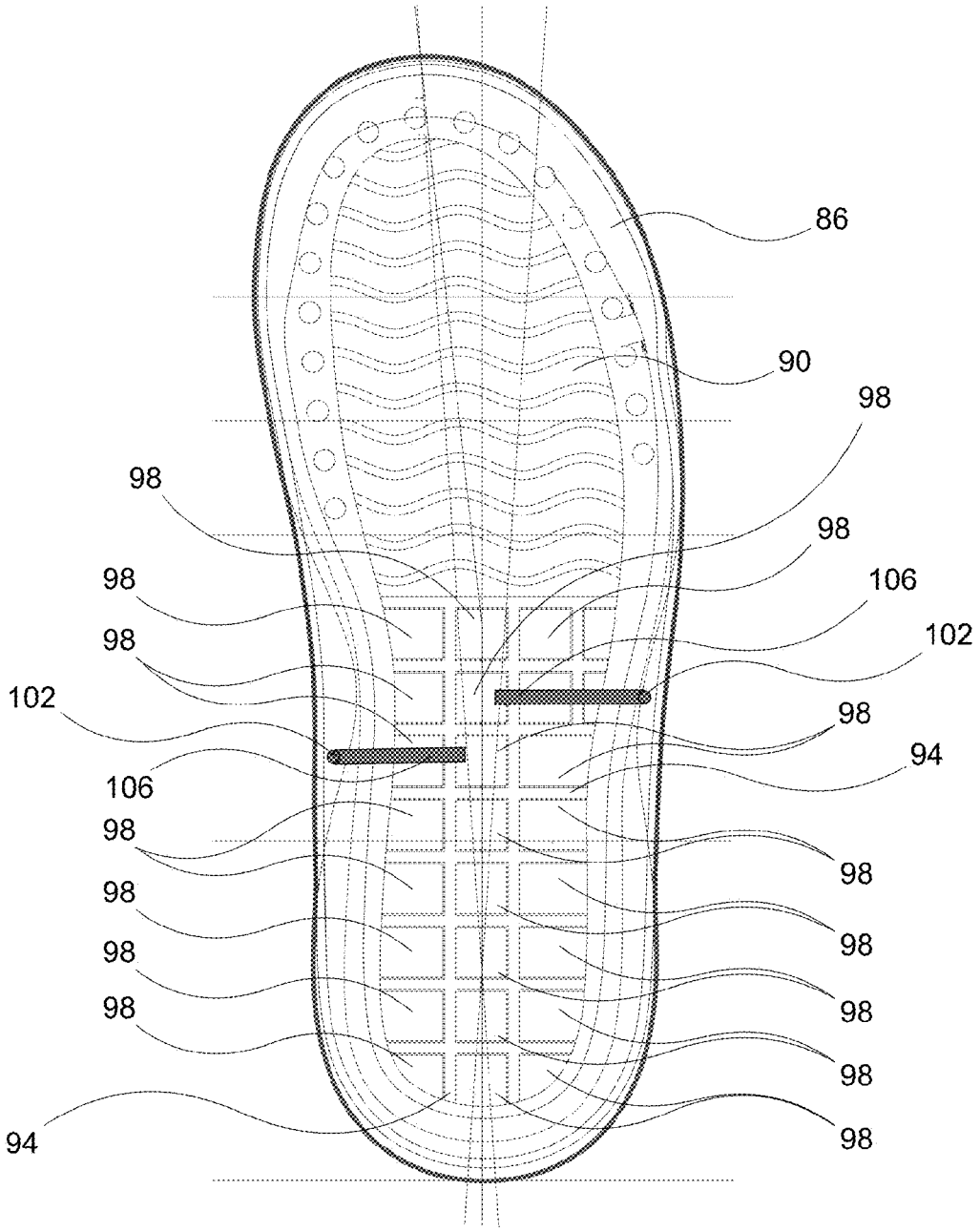
FIG. 5 is a plan view of a sole structure of a footwear in accordance with an embodiment of the present invention.

A typical rubber sole 86 construction is illustrated in FIG. 5. The uncovered interior portion 90 of the sole 86, with the additional internal layers removed for a better visibility, is illustrated to show a series of generally vertical and flexible/compressible ridges 94 and cavities 98 formed therein. Venting members 102 are also exemplified in FIG. 5. The venting members 102 are allowing air exchange between the cavities 98 in the sole 86 and the interior of the footwear 10 to flow to the environment through portions of the footwear 10. Venting members 102 are embodied in FIG. 5 as small tubes 106 although other embodiments are providing similar air exchange between the cavities 98 and the side of the footwear 10 like channels, drains, recessed portions or the like adapted to allow air passage thereof. One can appreciate that the illustrated sole 86 includes cavities 98 below the heel whereas additional cavities 98 (not illustrated) could be located under other portions of the foot without departing from the scope of the present invention. The exemplified sole 86 includes cavities 98 under the heel to use the substantial pressure generated by the heel to compress large cavities 98 under the heel.

Figure 6:
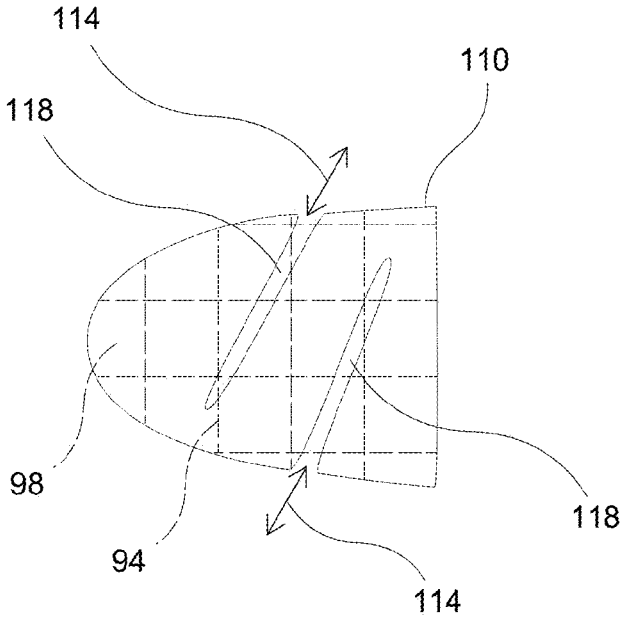
FIG. 6 is a plan view of an air exchange layer in accordance with an embodiment of the present invention.

Another embodiment is exemplified in FIG. 6 illustrating an air exchange layer 110 that is superposed on the series of ridges 94 and cavities 98 formed in the sole 86. The air exchange layer 110 is an alternative to the venting members 102 described above and has a thickness sufficient to allow passage of air 114 through slots 118 formed therein. The slots 118 are forming a generally horizontal channel between one or a plurality of ridges 94 and cavities 98 formed in the sole 86 and the exterior of the sole 86. The number, position, angle and width of the slots 118 can vary depending of the precise structure of the sole 86 and the amount of air to be channeled through the slots 118.

Figure 7:
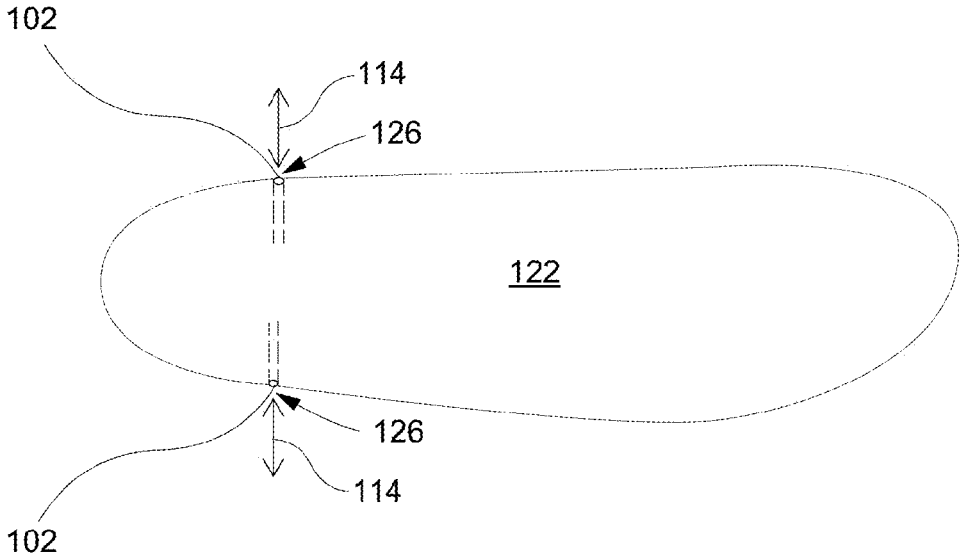
FIG. 7 is a plan view of an interior sole layer in accordance with an embodiment of the present invention.

An interior sole layer 122 is illustrated in FIG. 7. The interior sole layer 122 is superposed over the air exchange layer 110 to add structural strength to the sole assembly and cover the uneven structure of the sole 86. The interior sole layer 122 can also serve as a safety puncture-preventing layer in the case of a work boot against nails and other sharp objects. Puncture-preventing layers, in the case of a work boots, are preferably not including openings therein to prevent jeopardizing the safety of the wearer's feet. The interior sole layer 122 is provided with recessed portions 126 on one or both sides of the interior sole layer 122 to allow air passage from the sole's 86 cavities 98 to be channeled between the valve 42 to the series of openings 66 in the footwear 10 or through the air-breathable material layer(s) of the footwear 10 construction. A combined air-exchange layer 110 and interior sole layer 122 could be assembled, or merged, together and provides the desired result. The interior sole layer 122 could also be a thicker and include therein slots 118, or equivalent structure like channels, meshing or the like allowing the passage of air while protecting the foot against sharp objects.

Figure 8:
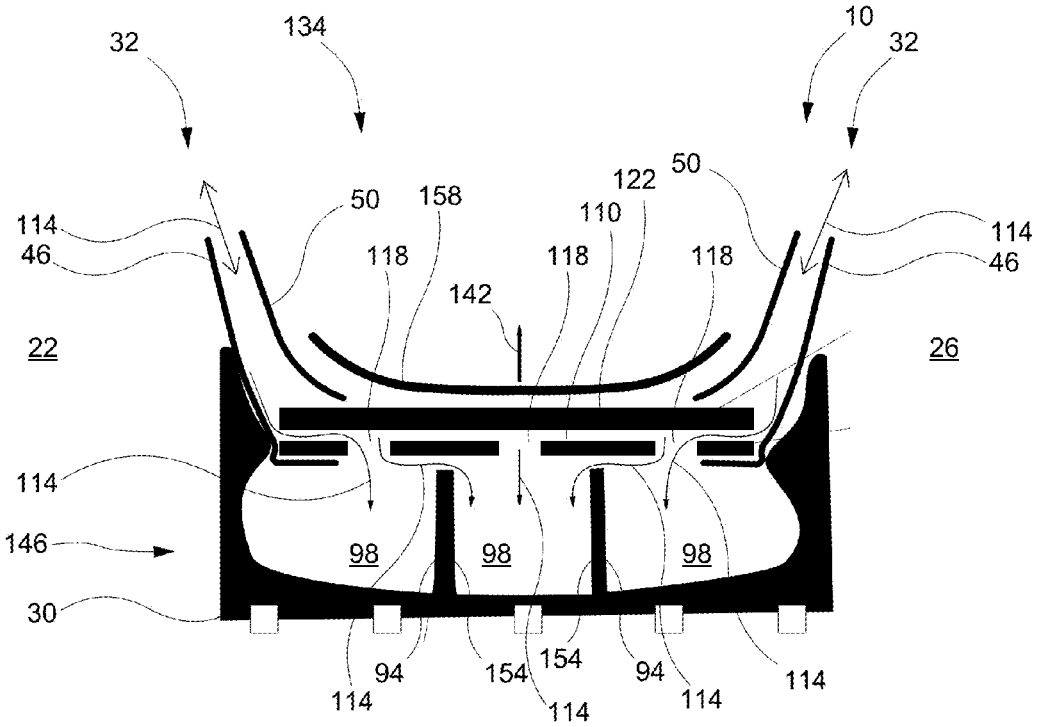
FIG. 8 is a section view of a sole assembly illustrating air flow therein when the sole is in the expanded configuration in accordance with an embodiment of the present invention.
Figure 9:
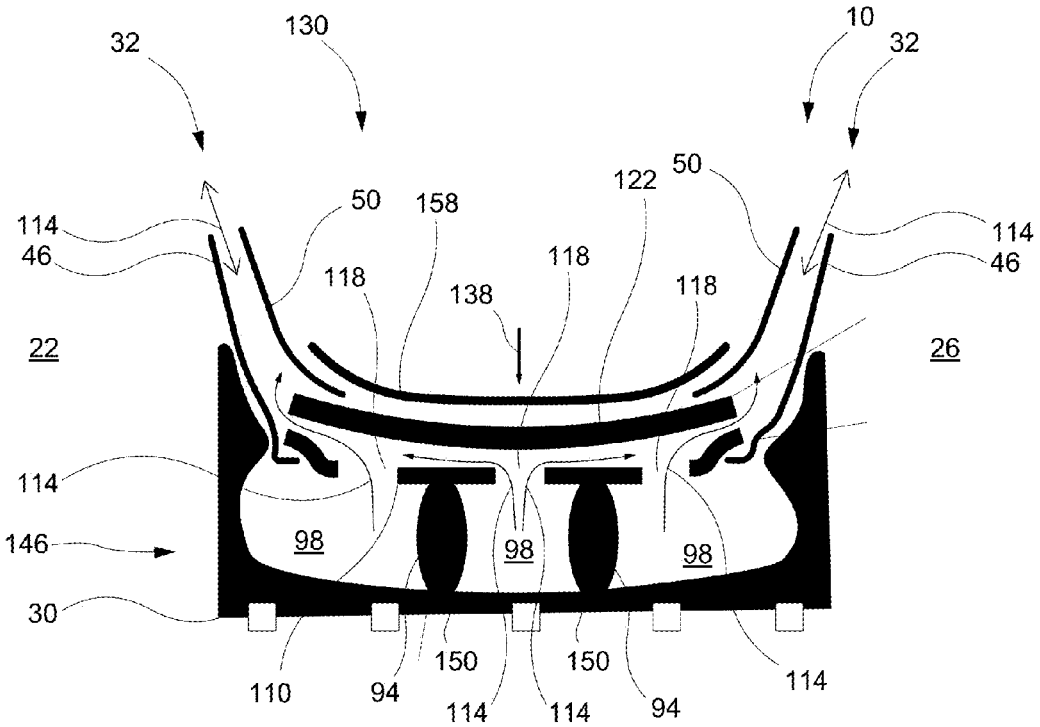
FIG. 9 is a section view of a sole assembly illustrating air flow therein when the sole is in the compressed configuration in accordance with an embodiment of the present invention.

The flexibility of the sole 30 material is used to pump air through the footwear 10. The compression of the cavities 98 formed in the sole 30 reduces the volume of the cavities 98. Conversely, release 142 of the compression 138 of the cavities 98 formed in the sole 30 increases the volume of the cavities 98 that are recovering their non-compressed configuration hence actuating the air pumping. The alternate passage between the compressed configuration 130 of the cavities 98, illustrated in FIG. 9, and the released configuration 134 of the cavities 98, illustrated in FIG. 8, when repetitively compressed 138 by a foot of a wearer when walking acts like a sequential and repetitive air pump 146. The weight of the wearer of the footwear 10 compresses the ridges 94 that are deforming 150 and allowing the interior sole 122 to get lower in the sole 30 hence reducing the volume of the cavities 98. The ridges 94 are recovering their original uncompressed state 154 when the weight of the wearer is not applied on the sole 30. An additional comfort layer 158 can optionally be added over the interior sole layer 122 or over the sole portion 30 structure under the foot for added comfort.

In a preferred embodiment, the sole 30 air pump 146 creates a stronger pressure, provided by the pressure of the foot in the footwear 10, than a vacuum, provided by the release of the pressure of the foot on the sole of the footwear 10. The stronger pressure is preferably used to extract air to the environment through the series of openings 66 and forces the valve 42 is in the air blocking configuration 82. In contrast, vacuum is used to aspire air from the environment through the series of holes 58 of the valve 42 when the valve 42 is in the air passing configuration 78.

Figure 10:
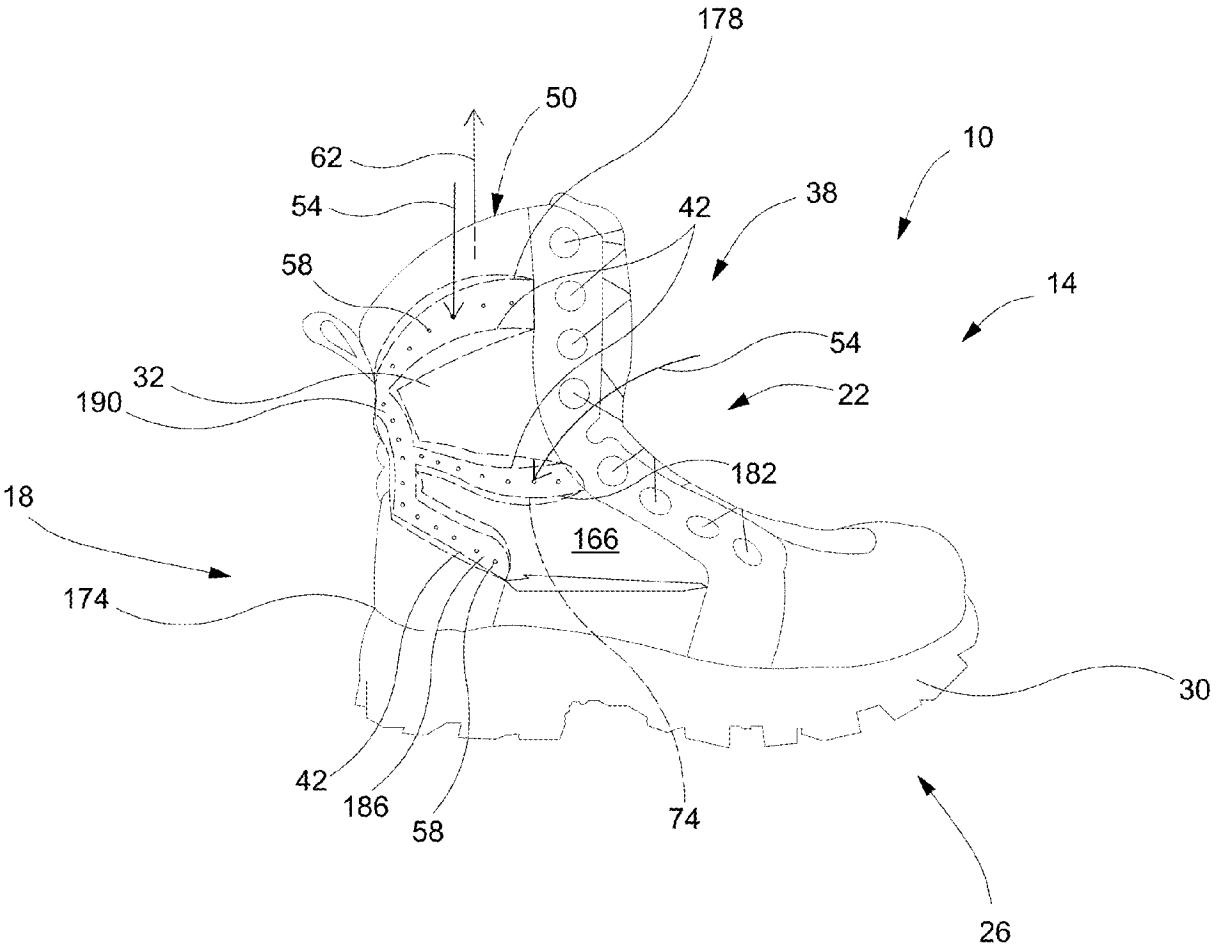
FIG. 10 is a side elevation view of the footwear in accordance with an embodiment of the present invention.
Figure 11:
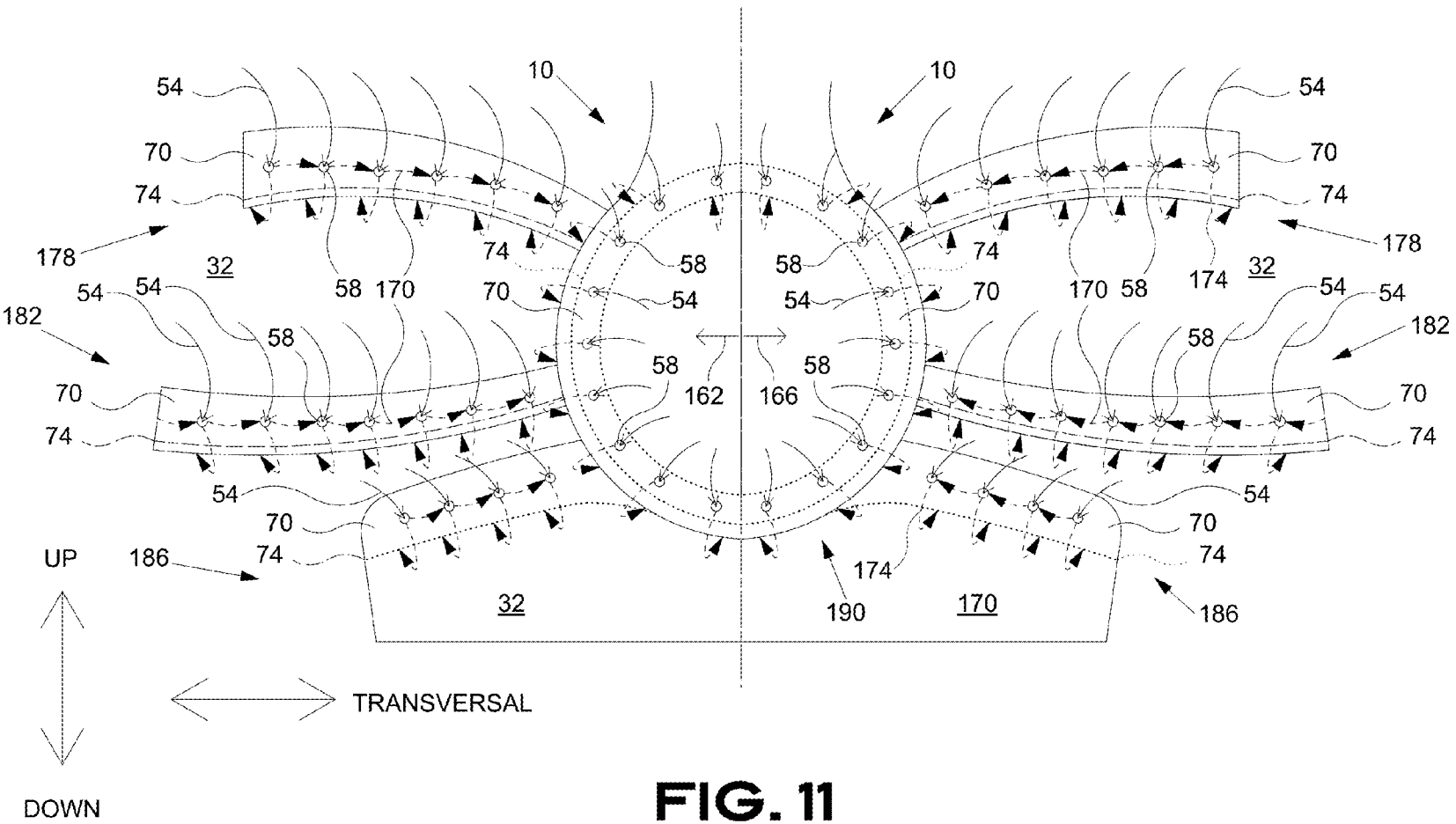
FIG. 11 is a rear elevation view of the footwear in accordance with an embodiment of the present invention.

An additional embodiment is illustrated in FIG. 10 and FIG. 11 where the valve 42 is covering at least one side of the footwear 10. The valve 42 is operationally aspiring air from the environment with a series of holes 58 (serving as air inlets) and includes a blocking layer 74 preventing dirt, water and moisture to get directly inside the footwear 10 through the side of the footwear 10. The blocking layer 74 is also superposed over the series of holes 58 inside the footwear 10 to restrict air movement and prevent air from within the footwear 10 to get out through the series of holes 58 hence favoring a pressure increase forcing air movement inside the footwear 10. The air collected inside the footwear 10 through the valve 42 is then moved internally toward the rear portion 18 of the footwear 10 as indicated by arrow 170 and after downwardly inside the footwear 10 as indicated by arrow 174.

Figure 12:
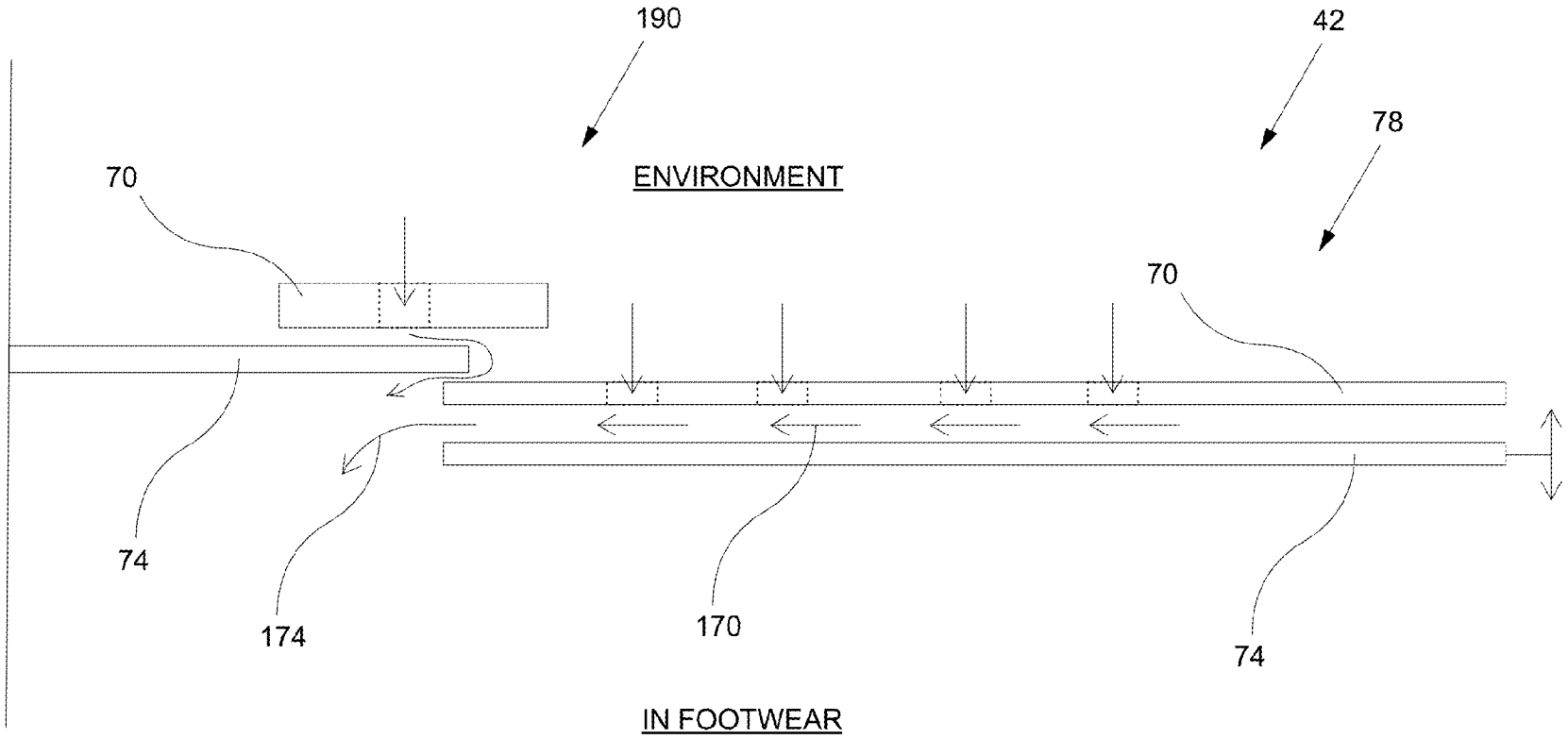
FIG. 12 is a partial and schematic top plan section view of the footwear in accordance with an embodiment of the present invention.

Still referring to FIG. 10 and FIG. 11, the embodied valve 42 includes a proximal lateral side 162 and a distal lateral side 166. Each side 162, 166 include an upper valve portion 178, a middle valve portion 182, a lower valve portion 186 and a rear valve portion 190, each preferably interconnected together. The air flow can follow the layout of the valve portions 178, 182, 186, 190 and/or move perpendicularly to the layout of the valve portions 178, 182, 186, 190. FIG. 12 illustrates a section view of the valve 42 depicting the materials overlapping and exemplifying the air flow therethrough.

Figure 13:
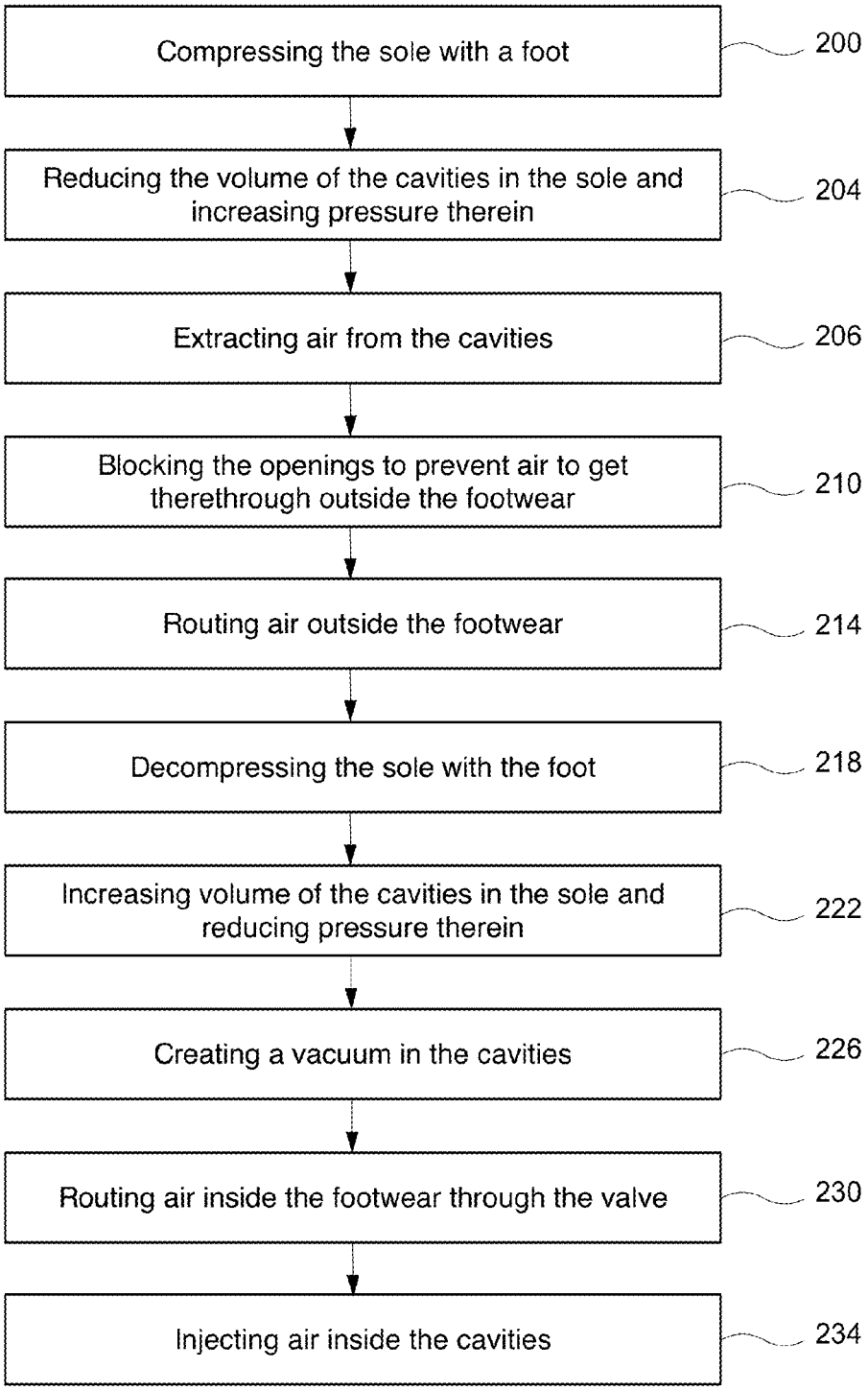
FIG. 13 is an exemplary flow chart of a method of actuating the air exchange in the footwear in accordance with an embodiment of the present invention.

A typical exemplary flowchart is shown in FIG. 13. The described sequential steps are exemplifying the pumping action of the footwear 10. A foot in the footwear 10 is compressing 200 the sole 30 and the cavities 98 therein. Reduction of volume of the cavities 98 increases pressure therein 204 and extract air 206 from the cavities 98. The valve 42 is blocking air 210 from being extracted by the series of holes 58 and routing air 214 outside the footwear 10. The cavities 98 are recovering their non-compressed configuration 218 with removal of the pressure from the foot, increasing volume of the cavities 98 in the sole and reducing pressure 222. Reduction of the pressure in the cavities 98 is generating vacuum thereof 226 that is collecting air from the environment through the valve 230 to fill 234 the cavities 98.

Figure 14:
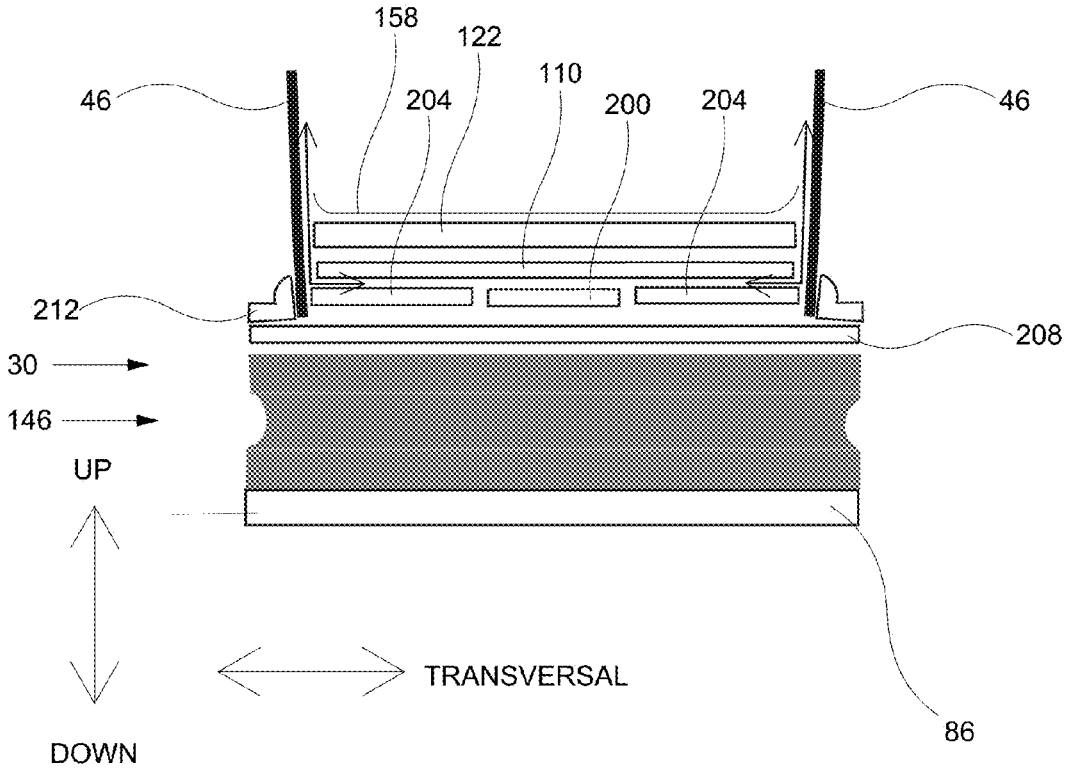
FIG. 14 is a rear elevation section view of a portion of the footwear in accordance with an embodiment of the present invention.
Figure 15:
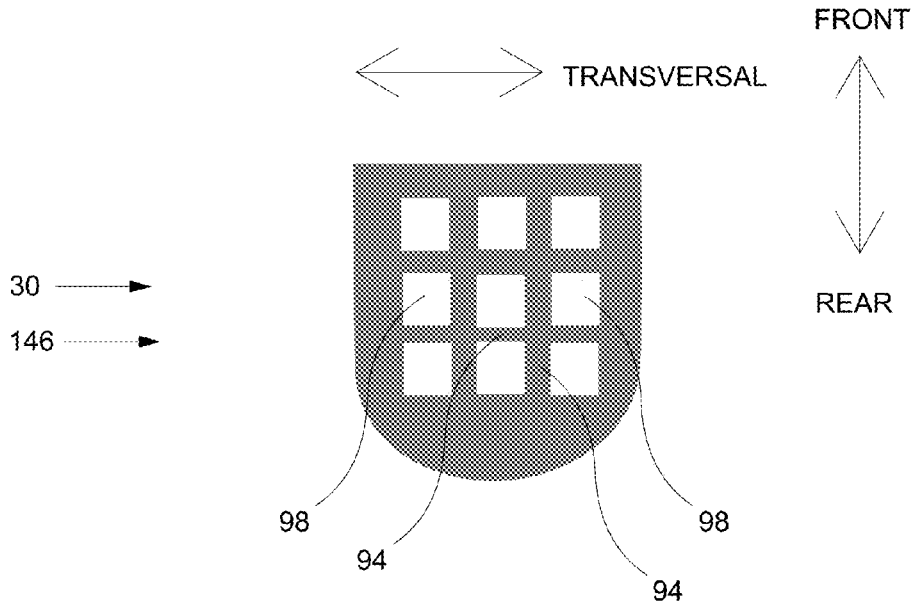
FIG. 15 is a top plan view of the footwear in accordance with an embodiment of the present invention.

FIG. 14 and FIG. 15 are illustrating another embodiment. More precisely, in reference with the cross-section view of FIG. 14, the air pumping sole construction includes a comfort layer 158 superposed to an interior sole layer 122 and an air-exchange layer 110. The air-exchange layer 110 is supported by a shank 200 generally disposed along a central axis of the footwear 10 over a partial width of the sole 30. The shank 200 is laterally bordered by stabilizers 204 preferably of a thickness comparable to a thickness of the shank 200 to evenly support a foot thereon. The stabilizers 204 are made with a breathable design, with perforations, mesh of the like in an alternate embodiment thereof. A soling sheet 208 is separating the sole 86 and the shank 200 and stabilizers 204. The soling sheet 208 is made with a breathable design, with perforations, mesh of the like in an alternate embodiment thereof. The exterior layer 46 of the footwear 10 is connected to the sole portion 30 with a [Goodyear™] welt 212 contouring the sole portion 30. A plan view of the cavities 98 and intervening ridges 94 in the sole 30 is depicted in FIG. 15. Different designs of cavities 98 and intervening ridges 94 are contemplated by the present specification. The size, number, locations and shape of the cavities 98 and intervening ridges 94 can vary, individually or collectively, without departing from the scope of the present invention.

Figure 16:
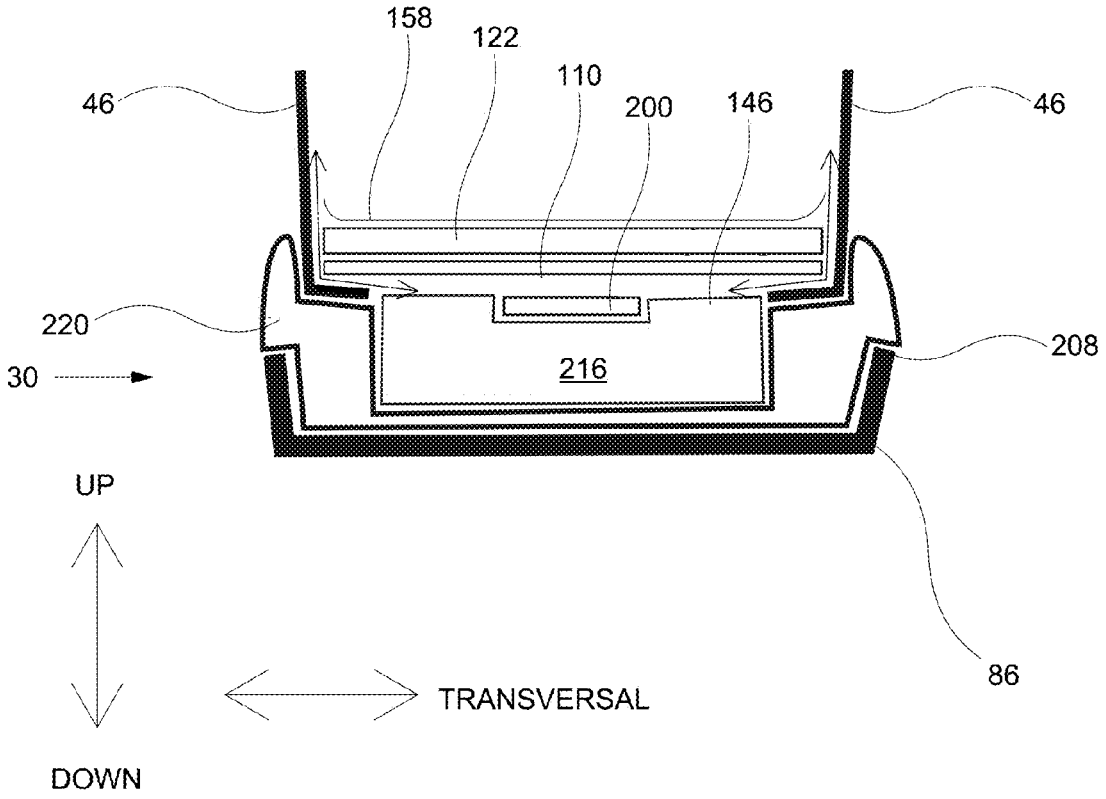
FIG. 16 is a rear elevation section view of a portion of the footwear in accordance with an embodiment of the present invention.
Figure 17:
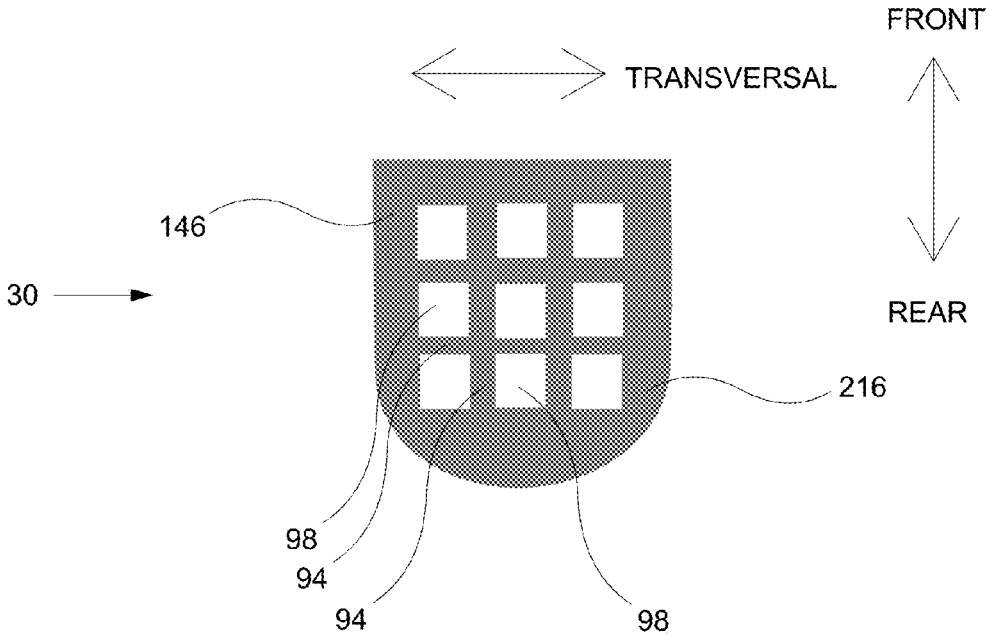
FIG. 17 is a top plan view of the footwear in accordance with an embodiment of the present invention.

Moving now to FIG. 16 and FIG. 17 that are illustrating another embodiment. More precisely, in reference with the cross-section view of FIG. 16, the air pumping sole construction includes a comfort layer 158 superposed to an interior sole layer 122 and an air-exchange layer 110. The air-exchange layer 110 is supported by a shank 200 generally disposed along a central axis of the footwear 10 over a partial width of the sole 30. The shank 200 is laterally bordered by portions of the air pump 146 to evenly support a foot thereon. The air pump 146, and the cavities 98 and intervening ridges 94, of the present embodiment is built with a body 216 that can be separated from other portions of the sole portion 30. The body 216 can be made of a flexible material suitable to perform the functions of the air pump 146. For example, the material of the body 216 could be made of a material like the rubber sole construction 86. The body 216 could use a material including the proper mechanical properties for the air pump 146 without having to sustain friction like the rubber sole construction 86. A plan view of the cavities 98 and intervening ridges 94 in the sole 30 is depicted in FIG. 17. Different designs of cavities 98 and intervening ridges 94 are contemplated by the present specification. The size, number, locations and shape of the cavities 98 and intervening ridges 94 can vary, individually or collectively, without departing from the scope of the present invention. The body 216 is secured and located in the sole 30 with, for instance, a "pu" injected material 220, a soft polymeric material, suitable for comfortably and sustainably support the foot of a wearer.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A pressure activated forced-air footwear comprising:

a foot-receiving portion for receiving a foot of a wearer therein;

a foot-covering portion covering the foot-receiving portion; and a foot-supporting portion supporting the foot-receiving portion and the foot-covering portion, the foot-supporting portion comprising a front portion for supporting a ball portion of the foot of a wearer; and a rear portion for supporting a portion of the foot of a wearer, the rear portion comprising an interior sole layer for supporting the heel portion of the foot of a wearer, an air-exchange layer supporting the internal sole layer, the air-exchange layer including at least one opening therein for allowing air exchange therein;

a ground-contacting sole supporting the air-exchange layer, the ground-contacting sole including a plurality of compressible cavities and a plurality of compressible ridges therein;

the compressible cavities including a compressed configuration, when compressed by the foot of a wearer, and an expanded configuration when not compressed by the foot of a wearer, the transition between the compressed configuration and the expanded configuration forcing an air exchange in the footwear.

2. The pressure activated forced-air footwear of claim 1, wherein the foot covering portion is further including an air passage therein allowing air circulation between the compressible cavities in the ground-contacting sole and an exterior of the footwear.

3. The pressure activated forced-air footwear of claim 2, wherein the air passage is further including a valve allowing air circulation therethrough in a single direction when alternating between the compressed configuration and the expanded configuration.

4. The pressure activated forced-air footwear of claim 3, wherein the valve is at least partially located on a side of the footwear.

5. The pressure activated forced-air footwear of claim 1, further comprising a venting member communicating between the compressible cavities and a foot-receiving volume of the footwear to allow air circulation between the compressible cavities and the foot-receiving volume of the footwear.

6. The pressure activated forced-air footwear of claim 5, wherein the venting member is transversally located in the footwear.

7. The pressure activated forced-air footwear of claim 1, further comprising an air-channeling slot in the air-exchange layer forming a channel communicating between the compressible cavities and the foot-receiving portion of the footwear to allow air circulation between the compressible cavities and the foot-receiving portion of the footwear.

8. The pressure activated forced-air footwear of claim 7, wherein the air-channeling slot is disposed at an angle in respect with the plurality of ridges in the ground-contacting sole.

9. The pressure activated forced-air footwear of claim 1, wherein the interior sole layer is a safety puncture-preventing layer.

10. The pressure activated forced-air footwear of claim 3, wherein air valve is laterally disposed over an ankle-covering portion of the foot-covering portion.

11. The pressure activated forced-air footwear of claim 1, wherein the internal sole layer is free of perpendicular holes therethrough.

12. The pressure activated forced-air footwear of claim 1, wherein the internal sole layer is adding structural strength to the foot supporting portion.

13. The pressure activated forced-air footwear of claim 1, wherein the internal sole layer is a safety puncture-preventing member.

14. The pressure activated forced-air footwear of claim 1, wherein the internal sole layer is further including a recessed portion on a lateral side thereof for allowing air circulation therethrough.

15. The pressure activated forced-air footwear of claim 1, wherein only the rear portion of the ground-contacting sole is equipped with compressible cavities adapted to force air exchange in the footwear.

16. The pressure activated forced-air footwear of claim 1, wherein the air-exchange in the footwear is circumventing the internal sole layer.

* * * * *